US005776035A

United States Patent [19]

Chen

[11] Patent Number: 5,776,035

[45] Date of Patent: Jul. 7, 1998

[54] STEPPING EXERCISER

[76] Inventor: Ping Chen, No. 29, Nanmei St., Nantun Li, Nantun Dist., Taichung,, Taiwan

[21] Appl. No.: 899,058

[22] Filed: Jul. 23, 1997

Related U.S. Application Data

[62] Division of Ser. No. 786,083, Jan. 17, 1997, Pat. No. 5,704,878.

[51] Int. Cl.[6] ..... A63B 21/00

[52] U.S. Cl. ..... 482/52; 482/57

[58] Field of Search ..... 482/51, 52, 53, 482/57, 63, 79, 80

[56] References Cited

U.S. PATENT DOCUMENTS

| | | | |
|---|---|---|---|
| 2,641,249 | 6/1953 | Brockman | 482/52 |
| 4,915,374 | 4/1990 | Watkins | 482/57 |
| 5,163,886 | 11/1992 | Seol | 482/57 |
| 5,704,878 | 1/1998 | Chen | 482/52 |

*Primary Examiner*—Stephen R. Crow
*Attorney, Agent, or Firm*—Gardere & Wynne, L.L.P.

[57] ABSTRACT

A stepping exerciser includes a base frame having a first end portion, a second end portion, a first side wall, and a second side wall. A supporting handle has a lower end portion mounted on the first end portion of the base frame, and an upper end portion with a handgrip. A driving axle is rotatably mounted on the second end portion of the base frame and has a first end and a second end extending through the first and the second side wall of the base frame respectively. A first stepping plate includes a mediate portion fixedly mounted on the first end of the driving axle and two distal end portions each with a first abutting edge vertically protruding outwardly. A second stepping plate is disposed in an inclined manner with the first stepping plate and includes a mediate portion fixedly mounted on the second end of the driving axle, and two distal end portions each with a second abutting edge vertically protruding outwardly. A tension adjusting mechanism is provided for damping a rotation of the driving axle.

3 Claims, 6 Drawing Sheets

STEPPING EXERCISER

CROSS-REFERENCE TO RELATED APPLICATIONS

The present invention is a divisional application of the Applicant's own U.S. patent application Ser. No. 08/786,083, filed on Jan. 17, 1997, now U.S. Pat. No. 5,704,848.

FIELD OF THE INVENTION

The present invention relates to a stepping exerciser.

BACKGROUND OF THE INVENTION

Sometimes, our activities are restricted to being indoors due to the heavy traffic or a bad weather, therefore, it is necessary to provide an exerciser which can be employed in the house for exercising purposes.

The present invention has arisen to solve the abovementioned problem.

SUMMARY OF THE INVENTION

In accordance with one aspect of the present invention, there is provided a stepping exerciser comprising a base frame having a first end portion, a second end portion, a first side wall, and a second side wall.

A supporting handle has a lower end portion mounted on the first end portion of the base frame in an inclined manner, and an upper end portion with a handgrip mounted thereon.

A driving axle is rotatably mounted on the second end portion of the base frame and has a first end and a second end extending through the first and the second side wall of the base frame respectively.

A first stepping plate includes a mediate portion fixedly mounted on the first end of the driving axle, and two distal end portions each having a first abutting edge vertically protruding outwardly.

A second stepping plate is disposed in an inclined manner with the first stepping plate and includes a mediate portion fixedly mounted on the second end of the driving axle and two distal end portions each with a second abutting edge vertically protruding outwardly.

A tension adjusting mechanism is mounted in the base frame and is engaged with the driving axle for damping a rotation of the driving axle.

The stepping exerciser further includes resistance means capable of creating a damping action for complementing the tension adjusting mechanism.

Further features of the present invention will become apparent from a careful reading of the detailed description with appropriate reference to the accompanying drawings.

DETAILED DESCRIPTION OF THE PREFERRED EMBODIMENTS

Figure 1:
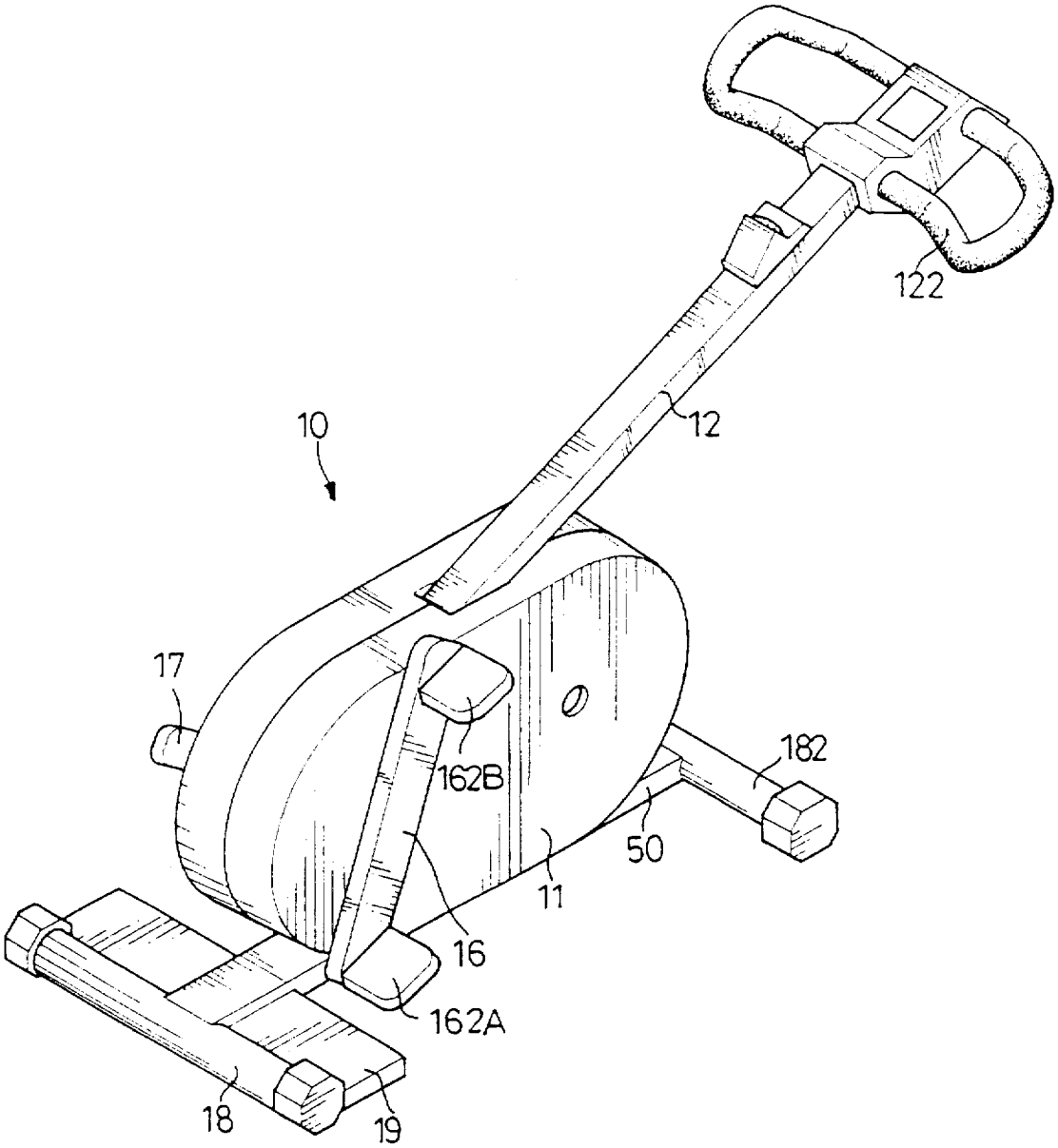
FIG. 1 is a perspective view of a stepping exerciser in accordance with the present invention.

Referring to the drawings, and initially to FIGS. 1–4, a stepping exerciser 10 according to the present invention comprises a base frame 11 having a first end portion, a second end portion, a first side wall, and a second side wall. A supporting handle 12 includes a lower end portion mounted on the first end portion of the base frame 11 in an inclined manner, and an upper end portion with a handgrip 122 mounted thereon.

A driving axle 15 is rotatably mounted on the second end portion of the base frame 11 and has a first end and a second end extending through the first and the second side wall of the base frame 11 respectively.

A bushing 54 is mounted around the driving axle 15, and a single bearing 152 (see FIG. 2) or two bearings 152 (see FIG. 3) is/are rotatably mounted between the driving axle 15 and the bushing 54.

An inverted T-shaped supporting member 50 includes an upright beam 52 fixedly mounted on an underside of the bushing 54 for supporting the driving axle 15 and the bushing 54, and has two distal ends each with a beam 18 and a beam 182 mounted thereon respectively. A limiting plate 19 is mounted on the supporting member 50 and is located adjacent to the beam 18.

A first stepping member has a mediate portion fixedly mounted on the first end of the driving axle 15, and a second stepping member is disposed in an inclined manner with the first stepping member and has a mediate portion fixedly mounted on the second end of the driving axle 15.

The first stepping member includes a first elongate beam 16 with two distal ends each having a first pedal 162A (or 162B) mounted thereon, and the second stepping member includes a second elongate beam 17 with two distal ends each having a second pedal 172A (or 172B) mounted thereon.

A tension adjusting mechanism 30 is mounted in the base frame 11 and is engaged with the driving axle 15 for damping a rotation of the driving axle 15. The stepping exerciser further includes resistance means capable of creating a damping action for complementing the tension adjusting mechanism.

The tension adjusting mechanism 30 includes a driving sprocket 31 fixedly mounted on the second end of the driving axle 15 to rotate therewith, a driven axle 36 rotatably mounted in the first end portion of the base frame 11, a driven sprocket 33 fixedly mounted on one end of the driven axle 36, a chain 32 meshing with the driving sprocket 31 and the driven sprocket 33, a tension wheel 34 fixedly mounted on a mediate portion of the driven axle 36, and a tension belt 35 mounted on a periphery of the tension wheel 34 and driven by the resistance means.

The tension wheel 34 can be driven to drive the driven axle 36 to rotate along a direction opposite to that of the rotation of the driving axle 15 by means of the tension belt 35 which is driven by the resistance means, thereby capable of providing a resistance for damping the rotation of the driving axle 15.

Figure 2:
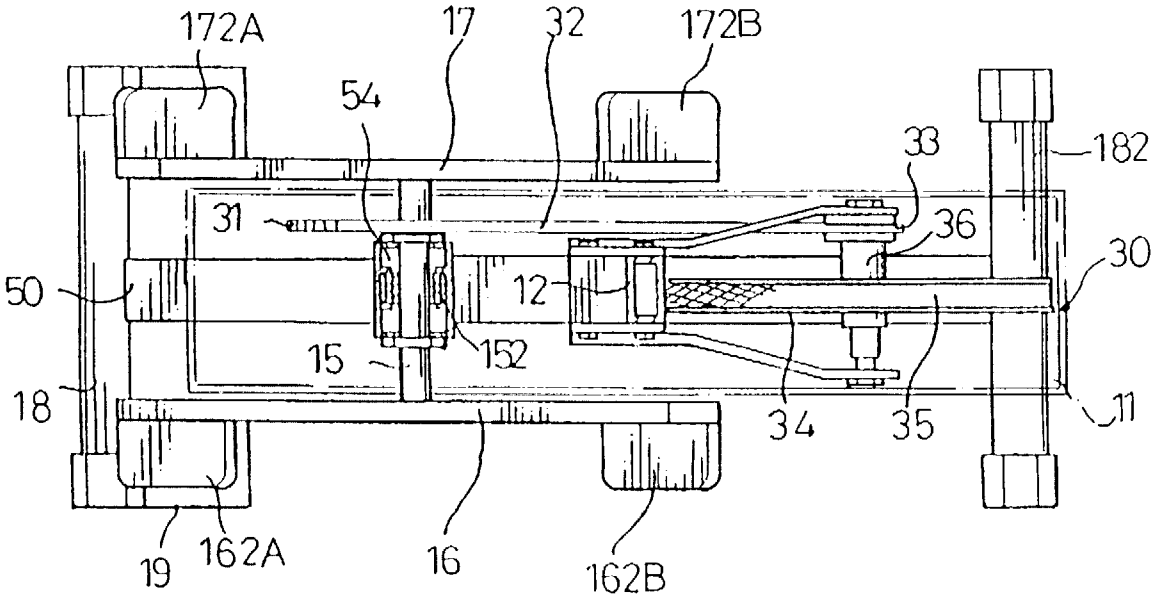
FIGS. 2 and 3 are top plan partially cross-sectional views of FIG. 1.
Figure 3:
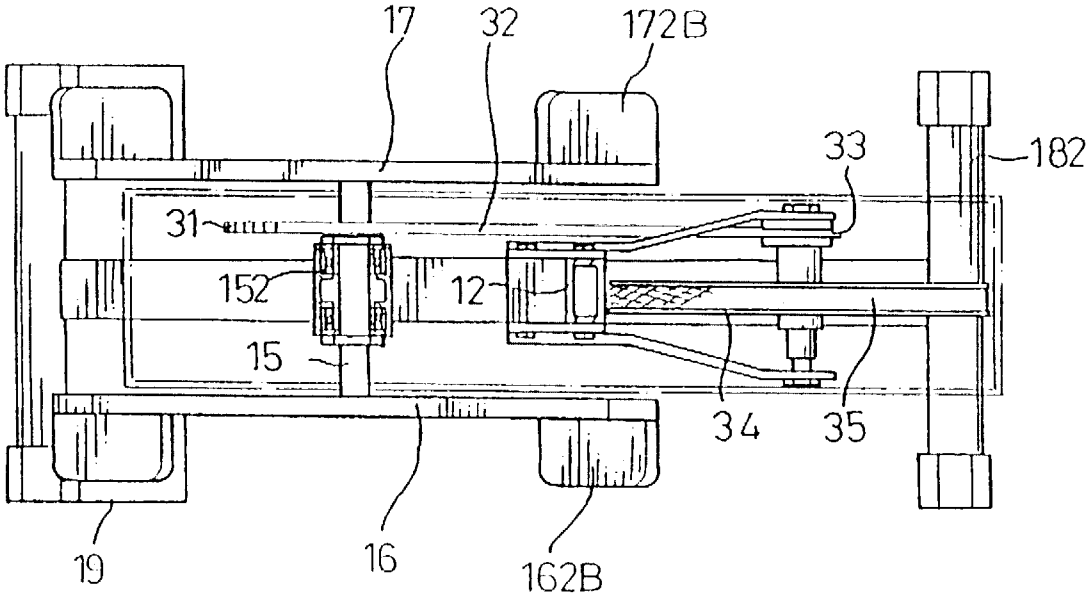
Figure 4:
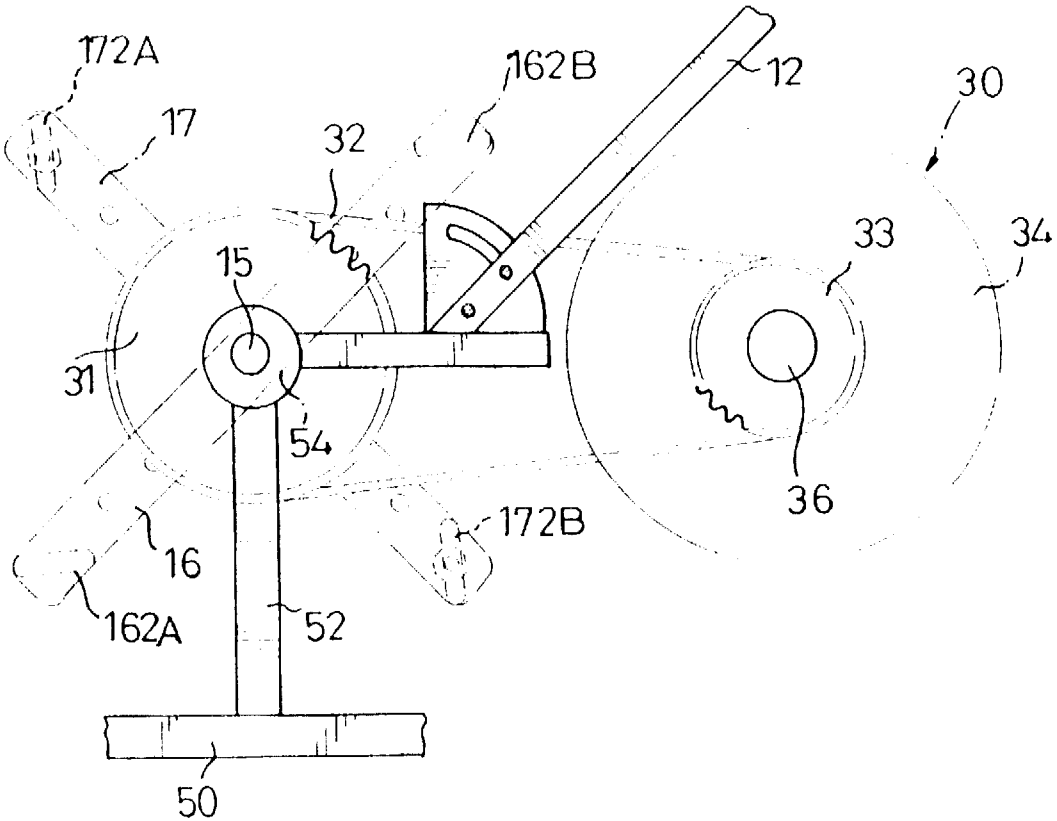
FIG. 4 is a front plan partially cut-away view of FIG. 1.
Figure 5:
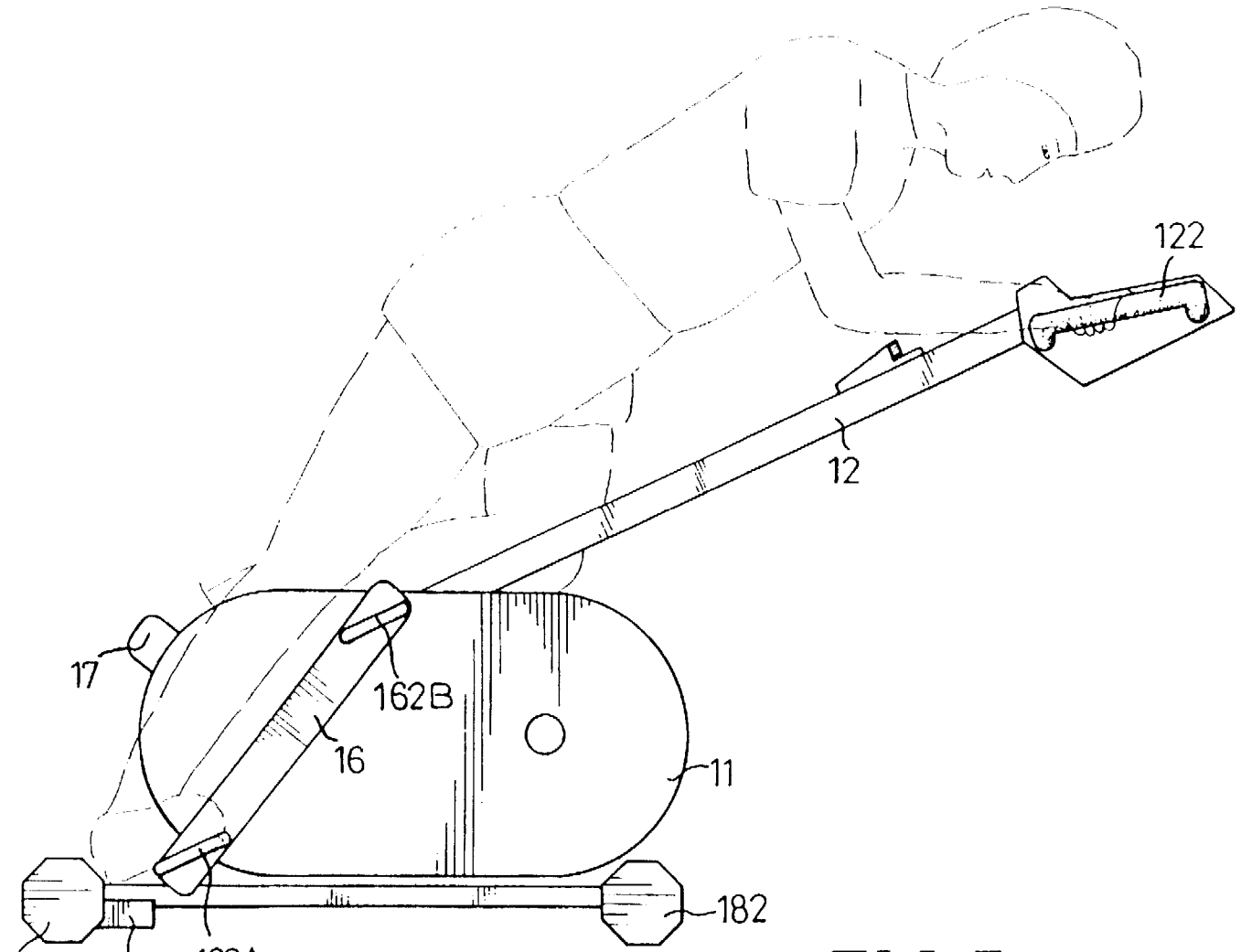
FIG. 5 is a front plan operational view of FIG. 1.

In operation, referring to FIGS. 4 and 5 with reference to FIGS. 1 and 2, a user can use the stepping exerciser with his two hands holding the handgrip 122, and with his right foot stepping on the first pedal 162A to rotate the driving axle 15, thereby rotating the second elongate beam 17 which can in turn rotate the second pedal 172A.

When the first pedal 162A and the second pedal 172A are moved to the position as shown in FIGS. 4 and 5, the user's left foot can step on the second pedal 172A to rotate the driving axle 15, thereby rotating the first beam 16 which can in turn rotate the first pedal 162B. In such a situation, the user's right foot can be elevated higher than the first pedal 162B, thereby preventing the first pedal 162B from hitting his right foot.

When the second pedal 172A is moved to a lowermost position, the user's right foot can step on the first pedal 162B to rotate the driving axle 15, thereby rotating the second beam 17 which can in turn rotate the second pedal 172B. In such a situation, the user's left foot can be elevated higher than the second pedal 172B, thereby preventing the second pedal 17 from hitting his left foot.

When the first pedal 162B is moved to a lowermost position, the user's left foot can step on the second pedal 172B to rotate the driving axle 15, thereby rotating the first beam 16 which can in turn rotate the first pedal 162A. In such a situation, the user's right foot can be elevated higher than the first pedal 162A, thereby preventing the first pedal 162A from hitting his right foot.

When the second pedal 172B is moved to a lowermost position, the user's right foot can step on the first pedal 162A to rotate the driving axle 15, thereby rotating the second beam 17 which can in turn rotate the second pedal 172A to the original position as shown in FIGS. 4 and 5. In such a situation, the user's left foot can be elevated higher than the second pedal 172A, thereby preventing the second pedal 172A from hitting his left foot.

The above-mentioned operations can be repeated such that the user can step on the first beam 16 and the second beam 17 alternately, thereby obtaining a stepping sensation so as exercise his body.

Figure 6:
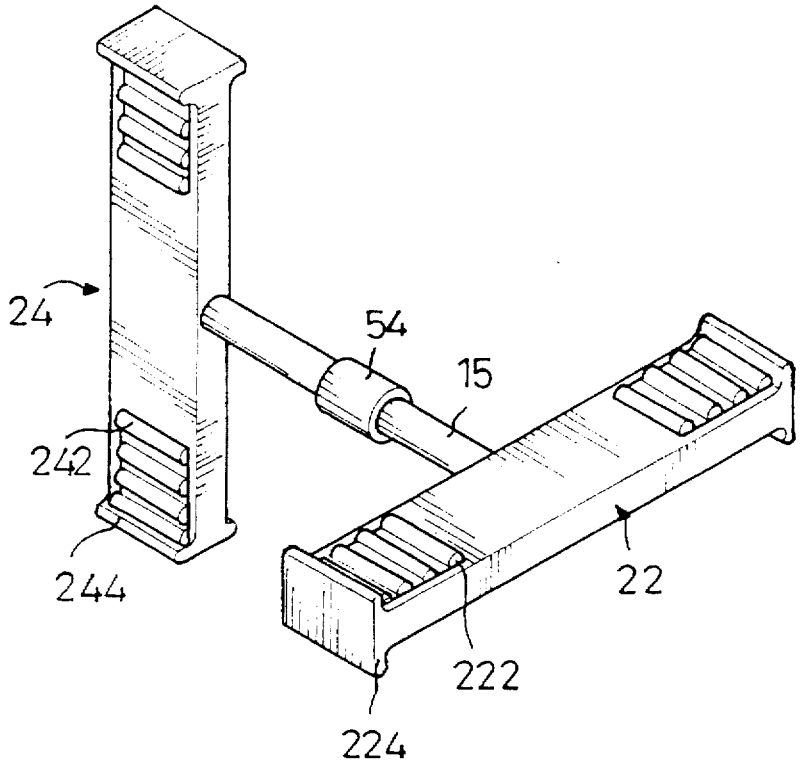
FIG. 6 is a perspective view of two stepping plates according another embodiment of the present invention.

Referring to FIG. 6, according to another embodiment of the present invention, the first stepping member includes a first stepping plate 22 having a mediate portion fixedly mounted on the first end of the driving axle 15, and two distal end portions each with a first abutting edge 224 vertically protruding outwardly. Each of the two distal end portions of the first stepping plate 22 is formed with a plurality of first ribs 222.

The second stepping member includes a second stepping plate 24 disposed in an inclined manner with the first stepping plate 22 and having a mediate portion fixedly mounted on the second end of the driving axle 15, and two distal end portions each with a second abutting edge 244 vertically protruding outwardly. Each of the two distal end portions of the second stepping plate 24 is formed with a plurality of second ribs 242.

It should be clear to those skilled in the art that further embodiments may be made without departing from the scope and spirit of the present invention.

What is claimed is:

1. A stepping exerciser comprising:

a base frame (11) having a first end portion, a second end portion, a first side wall, and a second side wall;

a supporting handle (12) having a lower end portion mounted on the first end portion of said base frame (11) in an inclined manner, and an upper end portion with a handgrip (122) mounted thereon;

a driving axle (15) rotatably mounted on said second end portion of said base frame (11) and having a first end and a second end extending through said first and said second side wall of said base frame (11) respectively;

a first stepping plate (22) including a mediate portion fixedly and directly mounted on said first end of said driving axle (15), and two distal end portions each with a first abutting edge (224) vertically protruding outwardly;

a second stepping plate (24) disposed in an inclined manner with said first stepping plate (22) and including a mediate portion fixedly mounted on said second end of said driving axle (15), and two distal end portions each with a second abutting edge (244) vertically protruding outwardly;

a tension adjusting mechanism (30) mounted in said base frame (11) and engaged with said driving axle (15) for damping a rotation of said driving axle (15); and resistance means capable of creating a damping action for complementing said tension adjusting mechanism.

2. The stepping exerciser in accordance with claim 1, wherein each of said two distal end portions of said first stepping plate (22) is formed with a plurality of ribs (222).

3. The stepping exerciser in accordance with claim 1, wherein each of said two distal end portions of said second stepping plate (24) is formed with a plurality of ribs (242).

* * * * *